US012006783B2

(12) United States Patent
Horn et al.

(10) Patent No.: US 12,006,783 B2
(45) Date of Patent: Jun. 11, 2024

(54) DOWNHOLE APPARATUS AND METHODS

(71) Applicant: Deltatek Oil Tools Limited, Aberdeen (GB)

(72) Inventors: Tristam Paul Horn, Westhill (GB); Stephen Edmund Bruce, Blairgowrie (GB); David Michael Shand, Banchory (GB); Tyler Rhes Reynolds, Magnolia, TX (US)

(73) Assignee: Deltatek Oil Tools Limited, Aberdeen (GB)

( * ) Notice: Subject to any disclaimer, the term of this patent is extended or adjusted under 35 U.S.C. 154(b) by 0 days.

(21) Appl. No.: 17/802,997

(22) PCT Filed: Mar. 9, 2021

(86) PCT No.: PCT/GB2021/050587

§ 371 (c)(1),
(2) Date: Aug. 29, 2022

(87) PCT Pub. No.: WO2021/181087

PCT Pub. Date: Sep. 16, 2021

(65) Prior Publication Data

US 2023/0117664 A1 Apr. 20, 2023

(30) Foreign Application Priority Data

Mar. 10, 2020 (GB) ..... 2003477
Dec. 4, 2020 (GB) ..... 2019183

(51) Int. Cl.
*E21B 17/14* (2006.01)
*E21B 33/14* (2006.01)
(Continued)

(52) U.S. Cl.
CPC ..... *E21B 33/143* (2013.01); *E21B 17/14* (2013.01); *E21B 33/16* (2013.01); *E21B 43/101* (2013.01)

(58) Field of Classification Search
CPC ..... E21B 17/14; E21B 33/143; E21B 43/101
See application file for complete search history.

(56) References Cited

U.S. PATENT DOCUMENTS 6,758,281 B2 * 7/2004 Sullaway ..... E21B 43/10 166/191
7,549,479 B2 6/2009 Biegler et al.
(Continued)

FOREIGN PATENT DOCUMENTS

CN 109611061 4/2019
DE 102009028306 2/2011
(Continued)

*Primary Examiner* — Matthew R Buck
(74) *Attorney, Agent, or Firm* — Dorton & Willis LLP; Ryan Willis

(57) ABSTRACT

A method of locating bore-lining tubing, such as a liner (120), in a drilled bore (106) comprises selecting a buoyant material, such as air (138), having a density lower than the density of an ambient fluid, such as well fluid (180, 182). The buoyant material (138) and an inner tubing (140) are located within the bore-lining tubing (120) with the inner tubing (140) extending from a distal end of the bore-lining tubing to a proximal end of the bore-lining tubing. The inner tubing (140) is sealed to the distal end of the bore-lining tubing (120) and to a portion of the bore-lining tubing (120) spaced from the distal end to define an inner annulus (152) between the inner tubing (140) and the bore-lining tubing (120). A volume of the buoyant material (138) is retained within the inner annulus (152). An assembly (168) comprising the inner tubing (140) and the bore-lining tubing (120) and containing the volume of buoyant material (138) is run into a drilled bore (106). Fluid (126*a*) may be flowed
(Continued)

through the inner tubing (140) and into an outer annulus (124) surrounding the bore-lining tubing (120).

20 Claims, 11 Drawing Sheets

(51) Int. Cl.
*E21B 33/16* (2006.01)
*E21B 43/10* (2006.01)

(56) References Cited

U.S. PATENT DOCUMENTS

| | | | | |
|---|---|---|---|---|
| 9,359,845 | B2 * | 6/2016 | Grodem | E21B 33/143 |
| 10,167,677 | B2 | 1/2019 | von Eberstein | |
| 2003/0116324 | A1 | 6/2003 | Dawson et al. | |
| 2004/0221997 | A1 * | 11/2004 | Giroux | E21B 33/143 166/380 |
| 2008/0149336 | A1 | 6/2008 | Szarka et al. | |
| 2020/0148933 | A1 | 5/2020 | Kibey et al. | |

FOREIGN PATENT DOCUMENTS

| | | | | |
|---|---|---|---|---|
| EP | 2039879 | | 3/2009 | |
| GB | 2226583 | | 7/1990 | |
| GB | 2376252 | | 12/2002 | |
| GB | 2003477.3 | | 11/2020 | |
| GB | 2019183.9 | | 9/2021 | |
| JP | H09-126353 | | 5/1997 | |
| SA | 522440430 | | 2/2024 | |
| WO | 82/01211 | | 4/1982 | |
| WO | 91/03620 | | 3/1991 | |
| WO | 92/19840 | | 11/1992 | |
| WO | 2016191578 | | 12/2016 | |
| WO | 2017023911 | | 2/2017 | |
| WO | 2019/025798 | | 2/2019 | |
| WO | WO-2019025798 | A1 * | 2/2019 | C09K 8/42 |
| WO | PCT/GB2021/050587 | | 5/2021 | |
| WO | PCT/GB2021/053139 | | 4/2022 | |

* cited by examiner

DOWNHOLE APPARATUS AND METHODS

This application is a national stage of PCT/GB2021/050587, filed Mar. 9, 2021, which claimed priority to Great Britain patent application number 2003477.3, filed Mar. 10, 2020, and Great Britain patent application number 2019183.9, filed Dec. 4, 2020, all of which are incorporated by reference.

FIELD

This disclosure relates to downhole apparatus and methods, and to well construction apparatus and methods. In particular, the disclosure relates to the location of bore-lining tubing in bores.

BACKGROUND

In the oil and gas exploration and production industry wells are constructed to provide access to subsurface hydrocarbon-bearing rock formations, with a bore being drilled from surface to intersect the hydrocarbon-bearing formation. After drilling a section of bore, metal tubing is placed in the bore and an annulus between the tubing and the wall of the drilled bore is sealed with cement. Successive bore sections are lined with smaller diameter metal tubing. The metal tubing may extend back to surface, such tubing being known as casing, or may only extend part way up the bore, such tubing being referred to as liner. A work or running string is used to support a section of liner as the liner is run into the bore, and the arrangement of supports, slips (gripping elements) and seals which secure and seal the upper end of a liner to the adjacent tubing is typically referred to as a liner hanger.

As a section of casing or liner is being lowered in the bore it is conventional to fill the tubing with drilling fluid. This prevents any imbalance between the interior of the tubing and the surrounding hydrostatic pressure as the tubing is run deeper into the fluid-filled bore.

The drilled bores may be vertical, inclined, or may include horizontal sections. For bores including extended horizontal sections it is known to "float" casing into a bore. In this technique air or low-density fluid is trapped in the lower section of the casing string to create a buoyant chamber, reducing the casing weight resting on the low side of the bore, and thus reducing drag and friction during the casing running process. Conventionally, the provision of the buoyant chamber prevents the circulation of fluid through the casing, which would otherwise be used to facilitate translation of the casing string through the bore.

U.S. Pat. No. 6,505,685 discloses methods and apparatus for creating a buoyant casing chamber between a float collar and a packer located within a casing. A length of tubing extends through the packer to the float collar such that fluid may be pumped down the casing and then through the tubing, the float collar, and a guide shoe on the distal end of the casing without disturbing the buoyant chamber. After the casing has been run to the target depth the packer is unseated and the packer and tubing removed to allow the casing to be cemented in the conventional manner.

When a section of casing or liner is being cemented in the bore the cement is pumped from surface down through the interior of the casing, or through the running string and the liner. Typically, the cement will completely fill the annulus surrounding a liner placed at the bottom or distal end of a bore and which may or may not intersect the hydrocarbon-bearing formation. Further, it is standard practice to prepare and pump a volume of cement slurry (cement, water, and chemical additives) in excess of the volume of the liner annulus to be filled to ensure the cemented volume matches or exceeds the annular volume to account for any drilled diameter excess and to ensure that the cement extends over and around the seals in the liner hanger. For intermediate liners and casing only a lower or distal section of the annulus may be filled with cement sufficient to ensure a hydraulic seal and to prevent hydrocarbon leakage from lower formations.

In conventional well casing or liner cementing operations a float shoe is provided at or adjacent the leading or distal end of the tubing, and a float collar is provided perhaps 80 to 160 feet (24.4 to 48.8 m) above the float shoe and provides a landing for cement wiper plugs; to avoid contamination by well or drilling fluid cement is pumped into the bore between bottom and top wiper plugs. The plugs provide a sliding sealing contact with the inner surface of the tubing and isolate the cement from the drilling fluid that otherwise fills the tubing. When the bottom plug lands on the float collar, continued application of hydraulic pressure from surface ruptures the bottom plug and forces the cement through the plug and the collar, into the volume between the float collar and the float shoe, and then through the float shoe and into the annulus. The cement continues to flow into and fill the annulus until the top plug lands on the bottom plug. The landing of the top plug on the bottom plug is detectable at surface, and at this point the pumping is stopped. This leaves a column of drilling fluid sitting above the top plug and a volume of cement within the distal end of the casing or liner, between the float collar and the float shoe; this volume is known as the shoe track. Typically, this volume of cement is 80 to 160 feet (24.4 to 48.8 m) long.

The provision of the shoe track minimises the risk of well fluid contamination of the cement which fills the annulus surrounding the bottom of the casing or liner, for example by leakage of well fluid past the top wiper plug. However, when the cement cures the operator is left with a solid plug of cement inside the shoe track.

In most instances the operator will choose to drill the cement out the shoe track. This requires provision of a drill bit which is only slightly smaller than the internal diameter of the casing or liner, to ensure removal of all the cement from within the tubing. If the operator is intending to extend the bore further the drill bit used to remove the cement from the shoe track may then be retrieved to surface and replaced with a slightly smaller drill bit. If the bore is not to be extended further the operator may likely still choose to remove the cement from the shoe track such that the distal end portion of the liner may be utilised to, for example, provide access to a surrounding hydrocarbon-bearing formation.

Methods and apparatus for use in running bore-lining tubing are described in applicant's earlier patent applications, including GB2565180A, GB2565098A, WO2019025798, WO2019025799, WO2017103601, EP3507447, GB2525148A, GB2545495A and GB1911653.2 the disclosures of which are incorporated herein in their entirety.

SUMMARY

According to an aspect of the disclosure there is provided a method of locating bore-lining tubing in a drilled bore, the method comprising:

selecting a buoyant material having a density lower than the density of an ambient fluid;

locating the buoyant material in a bore-lining tubing;

locating an inner tubing within the bore-lining tubing, with the inner tubing extending from a distal end of the bore-lining tubing to a proximal end of the bore-lining tubing;

coupling and sealing the distal end of the inner tubing to the distal end of the bore-lining tubing by engaging a coupling on the inner tubing with a coupling on the bore-lining tubing;

sealing the inner tubing to a portion of the bore-lining tubing spaced from the distal end to define an inner annulus between the inner tubing and the bore-lining tubing;

retaining a volume of the buoyant material within the inner annulus;

running an assembly comprising the inner tubing and the bore-lining tubing and containing the volume of buoyant material into a drilled bore; and flowing fluid through the inner tubing and into an outer annulus surrounding the bore-lining tubing.

The disclosure also relates to apparatus for use in the method.

The apparatus may comprise an assembly comprising: bore-lining tubing for location in a drilled bore; an inner tubing for extending from a distal end of the bore-lining tubing to surface; a coupling at a distal end of the bore-lining tubing; a coupling at a distal end of the inner tubing for engaging and sealing with the coupling at the distal end of the bore-lining tubing; a proximal seal between the bore-lining tubing and the inner tubing; an inner annulus between the distal ends of the bore-lining tubing and the inner tubing and the proximal seal; and a volume of buoyant material retained within the inner annulus.

An aspect of the disclosure relates to running the apparatus into a drilled bore. The presence of the buoyant material may provide the apparatus with a lower effective weight and thus may facilitate running the apparatus into the bore using a facility, for example a derrick on a mobile drilling unit, that would not otherwise have the capability to safely run an equivalent bore-lining tubing into the bore.

The presence of the buoyant material may provide the assembly with a degree of buoyancy when the assembly is passing through a body of water, for example between an offshore rig and the seabed, or is passing through a fluid-filled well bore. Thus, the ambient fluid may be, for example, seawater or drilling fluid. This may reduce the effective load which must be supported by a rig or the like. This buoyancy may also reduce the friction between the bore-lining tubing and the lower side of the drilled bore as the bore-lining tubing is advanced into an inclined or horizontal bore. The buoyancy and/or friction reduction may enable the operator to extend the possible length of bore-lining tubing to be installed in any one section of the wellbore. The buoyancy and friction reduction may facilitate rotation of the assembly in the bore, which may be useful in a situation where the bore is being drilled, reamed, or cleaned as the assembly is advanced into the bore. For these applications a cutting structure, such a drill bit or reaming shoe may be mounted to the distal end of the assembly. The assembly may also be rotated without being axially translated to, for example, facilitate cleaning of the bore, or to improve distribution of cement slurry which has been pumped into annulus surrounding bore-lining tubing.

The ability to flow fluid through the inner string offers advantages. For example, the method may comprise flowing fluid through the inner tubing and into the outer annulus to facilitate translation of the bore-lining tubing into the drilled bore, or cleaning of the bore. Alternatively, or in addition, the method may comprise flowing a settable material into the outer annulus to fill the outer annulus at least partially, the settable material subsequently hardening to secure or seal the bore-lining tubing in the drilled bore.

The steps of the method may be carried out in the order as described above, or may be carried out in a different order, and some steps described above may be carried out in two or more stages and separated by other steps. For example, the bore-lining tubing may be run part way into the bore before the inner tubing is positioned in the bore-lining tubing. Fluid may be flowed through the inner tubing and into the outer annulus while the assembly is being run into the bore, and once the assembly has been run into the drilled bore to target depth.

While running the assembly into the bore the assembly may be supported by a surface structure such as a land rig, an offshore rig, a floating rig, or other mobile offshore drilling unit. The inner tubing may comprise support tubing, such as a support string. For example, a work string or a running string may extend between the surface structure and the assembly. Fluid may be flowed through the supporting tubing to the inner tubing located within the bore-lining tubing.

The method may comprise retrieving the inner tubing from the bore-lining tubing. This may involve disengagement of the coupling on the distal ends of the inner tubing from the coupling on the distal end of the bore-lining tubing. The couplings may be disengaged by relative rotation, for example the couplings may be threaded. Alternatively, the couplings may disengage, or part of one of the couplings may be configured to release or fail, on a predetermined tension or torque being applied to the inner tubing.

The method may comprise coupling the proximal end of the inner string to the proximal end of the bore-lining tubing. The coupling between the proximal tubing ends may comprise a seal and may comprise the proximal seal. The proximal coupling may be incorporated in a running tool or a hanger setting tool. The method may further comprise uncoupling the proximal end of the inner string from the proximal end of the bore-lining tubing before disengaging the distal end of the inner tubing from the distal end of the bore-lining tubing.

The method may comprise setting a hanger provided on a proximal end of the bore-lining tubing. The hanger may include grips or slips which are settable to engage a surrounding tubing, such as a previously installed casing. The hanger may include a seal which is settable to provide sealing engagement between the bore-lining tubing and surrounding tubing. The grips or slips and the seals may be set in separate operations. For example, the grips or slips may be set or activated by application of fluid pressure, which may be applied via the inner tubing. The hanger seal may be set subsequently, for example by translation or manipulation of the inner tubing relative to the bore-lining tubing and may follow the completion of a cementing operation.

The method may comprise increasing or decreasing the distance between the distal and proximal ends of the inner tubing, for example by including an extendable portion in the inner tubing, such as a telescopic portion. The method may further include configuring the inner tubing whereby torque is not transmitted from the proximal end of the tubing to the distal end of the tubing, to permit rotation of the proximal end of the tubing without corresponding rotation of the distal end of the tubing. This may be achieved, for example, by providing a telescopic portion in the inner string capable of transmitting torque when in an extended configuration but not capable of transmitting torque when in a retracted configuration.

The method may comprise displacing the buoyant material from the inner annulus or dissolving or dissipating the buoyant material in other fluid, such as the ambient fluid or other fluid present in the inner annulus.

The buoyant material may completely or partially fill the inner annulus. The buoyant material may comprise a fluid such as air, nitrogen or another gas, a liquid such as a hydrocarbon or water, or a mix of materials. The buoyant material may comprise gas-filled spheres or may comprise a low-density solid material, such as a rigid foam. The ambient fluid may comprise water, brine, drilling fluid or "mud".

The inner annulus may be partially filled with further material, such as drilling fluid, having a density higher than the density of the buoyant material. The inner tubing may be initially air-filled and is then partially filled with a volume of the further material and an upper portion of the tubing left containing a volume of air to serve as the buoyant material. Alternatively, or in addition, the buoyant material may be injected or pumped into the inner annulus and may displace another material from the inner annulus. The inner annulus may be sealed while containing buoyant material at atmospheric pressure. The pressure within the inner annulus may be increased by pumping buoyant material, or another material, into the inner annulus. By increasing the pressure in the inner annulus, the bore-lining tubing may be protected against collapse due to the increasing hydrostatic pressure as the liner assembly is lowered into the fluid-filled drilled bore.

The inner tubing may be sealed to the bore-lining tubing intermediate the distal and proximal ends of the bore-lining tubing to create a sealed distal volume, for example by provision of packer or swab cup. Buoyant material may be provided in this sealed distal volume of the inner annulus. Alternatively, or in addition, the inner tubing may be sealed to the bore-lining tubing at the distal and proximal ends to create a sealed volume of similar length to the bore-lining tubing. This sealed volume may be sub-divided into multiple volumes which may contain different materials.

At least while in an initial configuration, the pressure in the inner annulus may remain substantially unaffected as fluid is pumped through the inner tubing. This may be useful in preventing ballooning of the bore-lining tubing. In the absence of the inner tubing, pumping cement slurry down through bore-lining tubing and into an outer annulus may result in a higher pressure within the bore-lining tubing, such that the tubing is radially extended. When the cementing of the tubing has been completed the tubing may radially contract, resulting a loss of sealing between the outer surface of the tubing and the surrounding cement.

The bore-lining tubing may take any appropriate form and may comprise casing or liner.

The inner tubing may take any appropriate form and may include steel drill pipe sections, steel tubing, coiled tubing, or lightweight equivalents including aluminium drill pipe, composite tubing, or hose.

A valve may be provided to permit fluid to flow out of the inner tubing and into the outer annulus, but which prevents flow from the outer annulus into the inner tubing. The valve may be mounted in the bore-lining tubing, for example in a shoe or collar at the distal end of the tubing, or the valve may be provided in a distal end of the inner tubing. One or more valves may be provided.

The buoyant material may be circulated out of the inner annulus or may be permitted to bleed from the inner annulus, or other fluid may be permitted to bleed or flow into the inner annulus and intermix with or absorb or dissipate the buoyant material. The buoyant material may travel from the inner annulus up through the bore. The buoyant material may travel up through tubing, such as a work or running string used to support the assembly in the bore or may travel up through an annulus between such a work or support string and an existing bore-lining tubing. The method may further comprise the controlled release of the buoyant material at surface; if the buoyant material is a gas or other compressible material, the material will expand as the material travels upwards and the hydrostatic pressure in the bore decreases. In the absence of careful control of the flow of fluid from the bore, the expanding buoyant material could exit the bore in a sudden and potentially dangerous manner and could displace other fluids from the bore.

The inner tubing may include at least one flow port to permit fluid communication between the inner tubing and the inner annulus. The flow port may comprise a valve. The valve may be initially closed to isolate the inner annulus from the inner tubing and may be subsequently opened. Multiple flow ports may be provided and may be opened or closed in a desired sequence.

The inner tubing coupling may latch into the bore-lining tubing coupling. The inner tubing coupling may be a male coupling and the bore-lining tubing coupling may be a female coupling. The engagement and sealing of the couplings may be achieved simply by axial translation of the inner tubing coupling relative to the bore-lining tubing coupling. The latching-in may be facilitated by the provision of an appropriate connector and seal. The inner tubing may be disconnected from the distal end of the bore-lining tubing by relative rotation or by application of an appropriate axial tension.

The inner tubing may attach to the proximal end of the bore-lining tubing via a threaded connection.

The method may comprise locating the upper or proximal end of the bore-lining tubing beneath a body of water, for example locating the upper end of a casing string at the seabed. Alternatively, or in addition, the method may comprise locating the upper or proximal end of the bore-lining tubing within the drilled bore, for example locating the upper end of a liner within a section of casing. Thus, the upper end of the liner may be located below the seabed.

The buoyant material may be selected to have a lower density than the ambient fluid and may have a lower specific gravity/relative density than the ambient fluid.

Another aspect of the disclosure relates to a method of cementing bore-lining tubing in a drilled bore, the method comprising:

- isolating at least a portion of an inner annulus defined between a bore-lining tubing and an inner tubing extending through the bore-lining tubing; and
- flowing cement slurry through the inner tubing and into an outer annulus surrounding the bore-lining tubing, with the cement slurry in the inner tubing at a first pressure; and
- maintaining the isolated portion of the inner annulus at a second pressure lower than the first pressure.

This aspect of the disclosure may facilitate the prevention of "ballooning" of bore-lining tubing during a cementing operation due to the elevated pressure of cement slurry being delivered down through the bore-lining tubing.

This aspect of the disclosure may be usefully employed with other settable materials.

The various features described above and as recited in the attached claims may have individual utility and as such may be provided individually, or in combination with any other features described herein, or in combination with any of the features as recited in the appended claims.

BRIEF DESCRIPTION OF THE DRAWINGS

These and other aspects of the disclosure will now be described, by way of example, with reference to the accompanying drawings, in which.

DETAILED DESCRIPTION OF THE DRAWINGS

Figure 1:
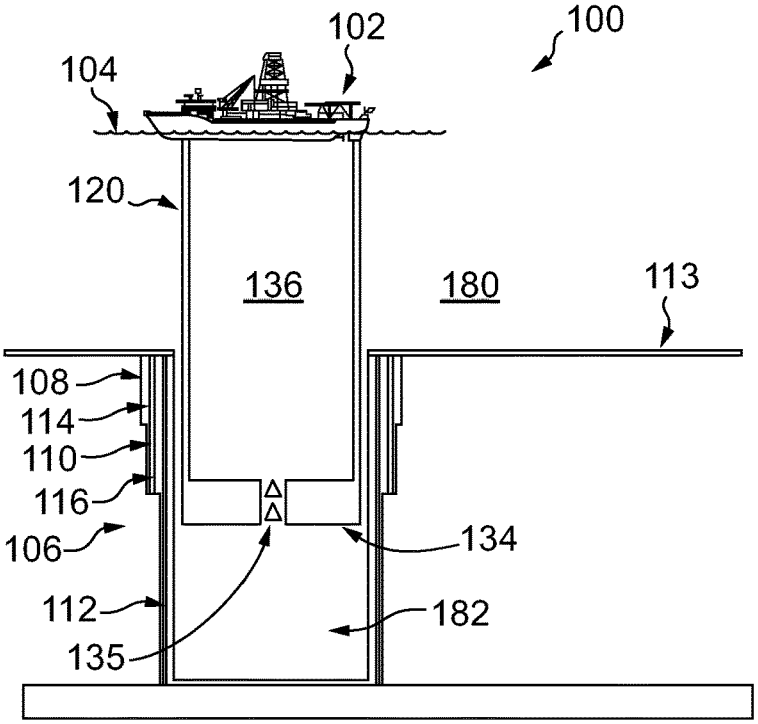
FIGS. 1 to 5 are schematics of a deep-water oil and gas well illustrating a well construction method and apparatus in accordance with a first aspect of the present disclosure.

Referring first to FIGS. 1 to 9 of the drawings, a deep-water oil and gas well 100 is illustrated. Well construction operations are conducted primarily from a mobile offshore drilling unit 102 on the sea surface 104. The well 100 includes a bore 106 which has been drilled from the seabed/mud line 113 in sections and lined with successively smaller bore-lining tubing sections 108, 110, 112, 120. FIGS. 1 to 5 of the drawings illustrate steps in the installation of the final tubing section, in the form of a liner 120, in the bore 106.

The illustrated well 100 includes three casing sections 108, 110 and 112 which extend back to the seabed 113 and serve to support the surrounding bore wall, which may include weak zones which would otherwise be liable to collapse. The casings 108, 110, 112 also isolate any water, gas or oil-bearing zones and provide support for the next casing. An annulus 114 surrounds each casing 108, 110, 112 and is at least partially filled with settable material, typically a cement 116.

Figure 3:
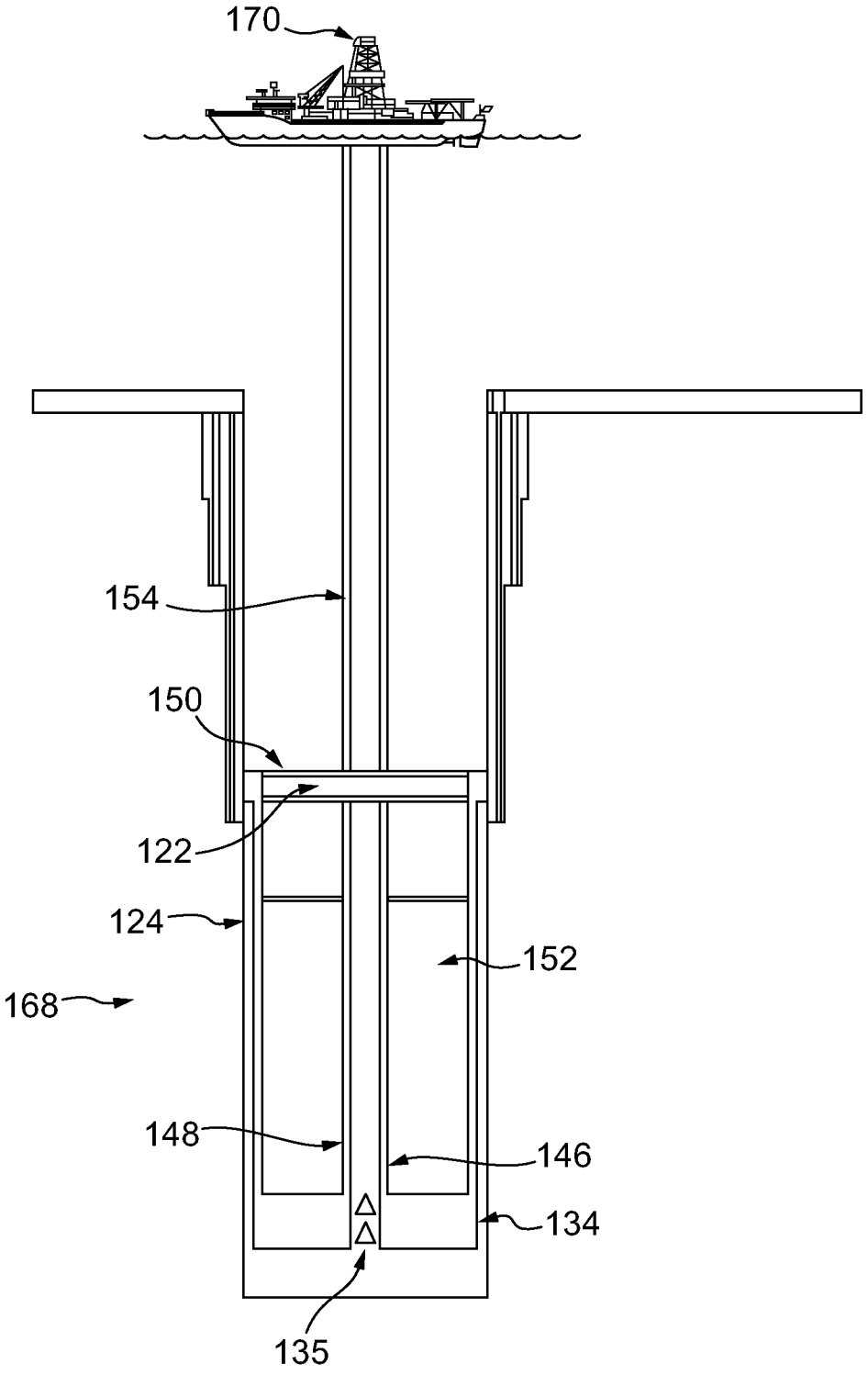
Figure 4:
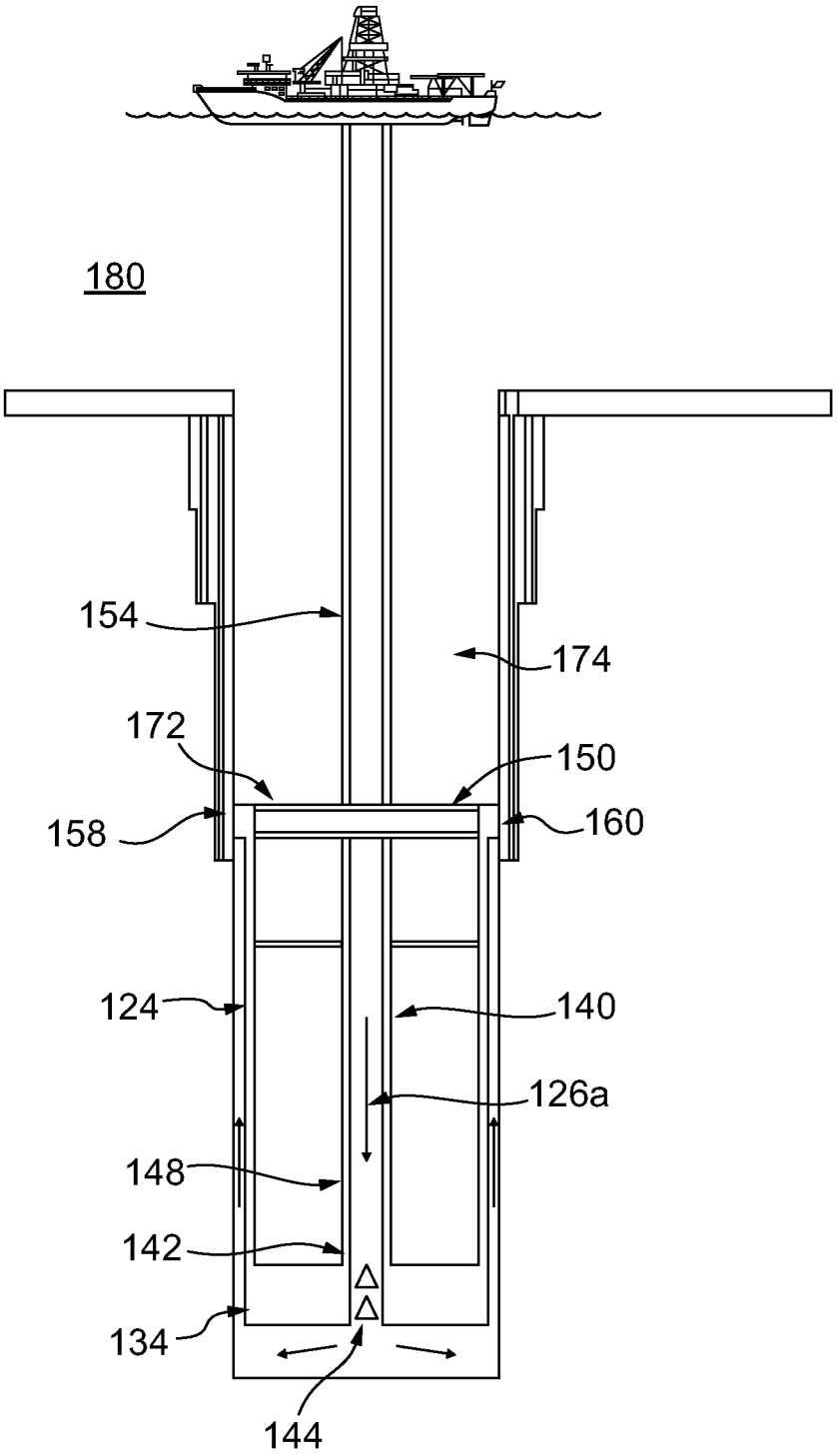
Figure 5:
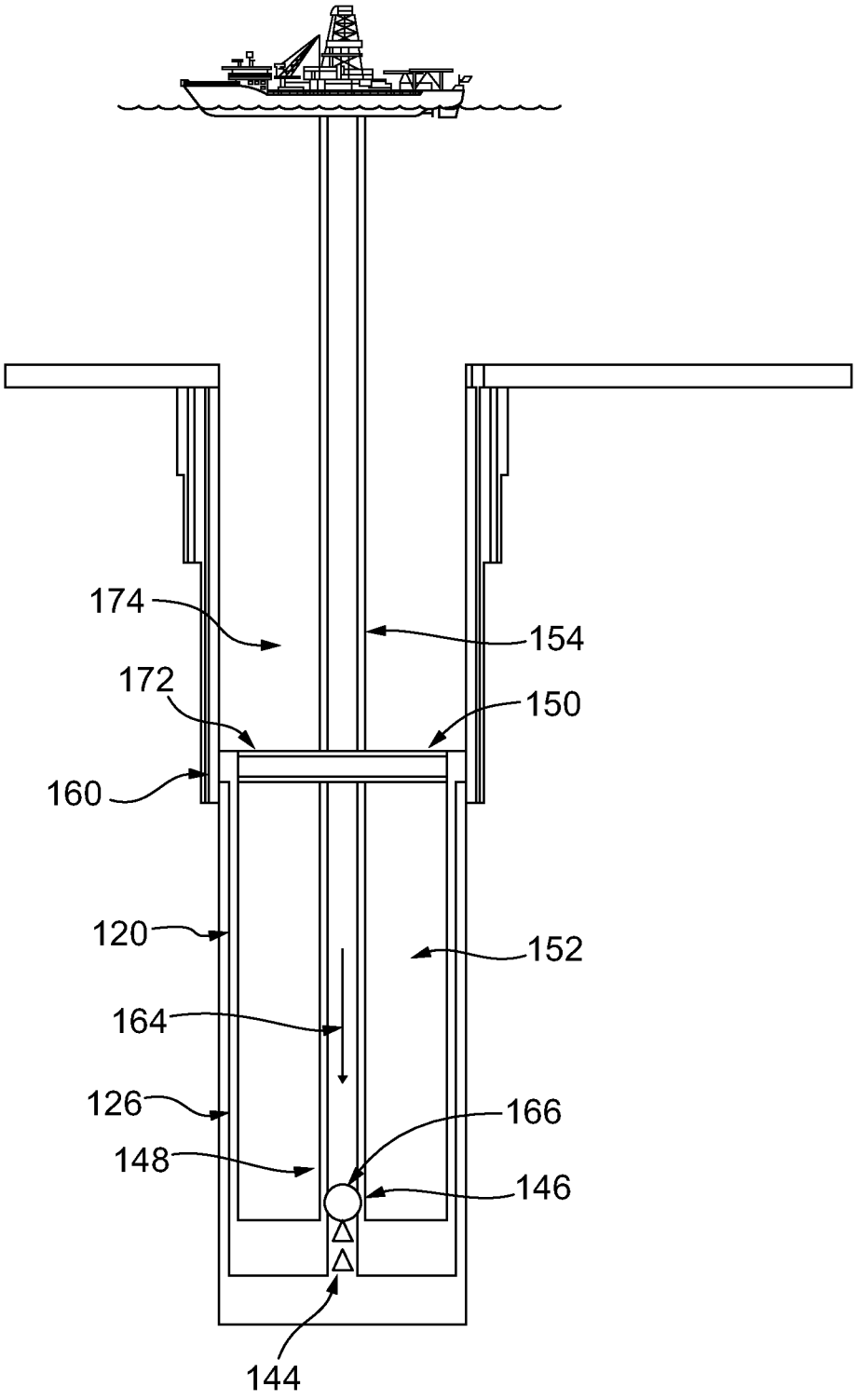

FIGS. 1 to 9 illustrate the installation of a liner 120 which extends to the end of the bore 106. The liner 120 may have a generally similar form to the casings 108, 110, 112 but does not extend back to the seabed 113. In this example the liner 120 is ultimately sealed and secured to a distal portion of the innermost casing 112 with a liner hanger 122. An outer annulus 124 between the liner 120 and the surrounding bore wall is sealed with cement 126 (FIG. 5).

In the illustrated well 100 the first casing 108, sometimes referred to as a conductor, is a 36" (91.4 cm) casing 108, that is a casing having an external diameter of 36 inches (91.4 cm). The casing 108 may have been placed by jetting, that is by providing a shoe on the lower or distal end of the casing 108 and pumping water through jetting nozzles internal to the shoe to displace sediment and allow the casing 108 to be lowered into the seabed. In other situations, the casing may have been run into a drilled bore and then sealed and secured in the bore within a cement sheath.

A 28" (71.1 cm) casing 110 is next located in the bore 106, followed by a 22" (58.4 cm) casing 112. A 22" (58.4 cm) bore is drilled and under reamed beyond the end of the casing 110. An 18" (45.7 cm) liner 120 is then run into and cemented in the bore 106, as described in detail below.

The liner 120 is made up from liner sections on the deck of the drilling unit 102 (FIG. 1). The leading or distal end of the liner 120 is provided with a liner shoe 134, as illustrated in greater detail in FIG. 6, which illustrates details of elements provided at the distal ends of the liner and an inner string 140. The shoe 134 is a float shoe including a double check-valve 135 and has a coupling 128 incorporating a sealing face, for example a seal bore 129, to allow an end coupling in the form of an adaptor or latch-in tool 142 mounted on the end of an inner string 140 to form a sealing engagement with the shoe 134, as will be described. The inner string 140 will typically be of significantly smaller diameter than the liner 120, and in this example the inner string 140 may have an outer diameter of 5", 5½" or 5⅞" (12.7, 14.0 or 14.9 cm). In other examples the inner string 140 may have any appropriate diameter, such as between 2⅞" and 5⅞" (7.3 and 14.9 cm).

Once the liner 120 has been made up and is suspended from the slips on the deck of the drilling unit 102, the liner internal volume 136 is partially filled with a flowable material 137. The material 137 may be a fluid as conventionally utilised in well construction operations, such as drilling fluid or brine, or may be a lower density fluid such as a light hydrocarbon. An upper or proximal portion of the volume 136 is left containing a volume of air 138.

Figure 2:
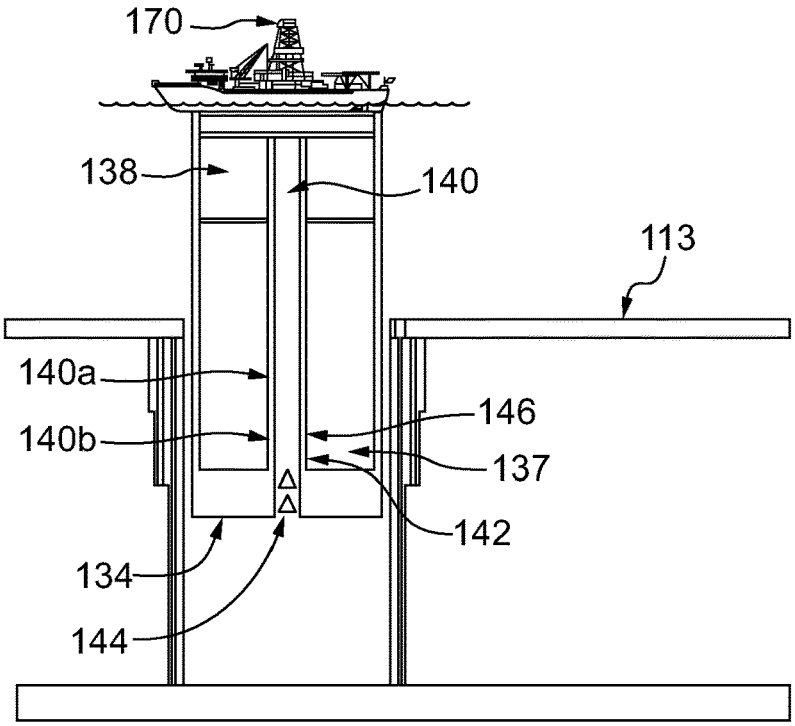

The inner string 140 is then made up and run into the liner 120 (FIG. 2). The distal end of the inner string 140 is provided with a coupling in the form of a latch-in connector 142, shown in greater detail in FIG. 6, which is adapted to be latched into a flow passage 144 in the liner shoe 134, the male-form connector 142 including a sprung latch 141 which engages a corresponding profile 130 in the female-form shoe coupling 128. Seals 143 provided around the leading end of the connector 142 engage with the shoe coupling seal bore 129. The end connector 142 may be disengaged from the shoe 134 by rotating the connector 142 relative to the shoe 134. Alternatively, the inner string 140 may be separated from the shoe 134 by applying an overpull, which shears retaining pins provided within the connector 142 and allows separation of distal elements of the connector 142, including the latch 141, from proximal elements of the connector 142.

The lower or distal end of the inner string 140 includes ports 146 including burst discs or other forms of valve. The valves in the ports 146 are initially closed. The inner string 140 also includes a telescopic section 148, as illustrated in a retracted configuration in FIG. 7. The section 148 includes an outer member 149*a* coupled to a proximal box connection 151*a* and an inner member 149*b* coupled to a distal pin connection 151*b*. The outer and inner members 149*a*, 149*b* are in a sealing sliding relationship and with the inner member 149*b* fully retracted within the outer member 149*a* the inner member 149*b* is rotatable relative to the outer member 149*a*. Thus, in the retracted configuration, it is not possible to transfer torque from the upper box connection 151*a* to the lower pin connection 151*b*. However, when the telescopic section 148 is extended, as may occur due to gravity pulling on the lower end of the string 140 and as occurs when the interior of the string experiences elevated fluid pressure, for example as fluid is being pumped through the string 140, complementary splined portions provided on the members 149*a*, 149*b* engage and permit the transfer of torque through the section 148. As noted above, when the section 148 is retracted or compressed an upper portion of the string 140*a* is rotatable relative to a lower portion 140*b*. The telescopic section 148 may include features such as described in GB2525148A and GB2545495A, the disclosures of which are incorporated herein in their entirety.

The telescopic section 148 may be provided at any appropriate location in the inner string 140.

Once the inner string 140 has been made up to the appropriate length within the liner 120 the latch-in end connector 142 may engage and connect and seal with the coupling 128 in the shoe 134, simply be advancing the connector 142 into the coupling 128. Pulling back on the string 140 will confirm that the connector 142 and shoe 134 are properly engaged or having set down weight may provide engagement confirmation.

Figure 8:
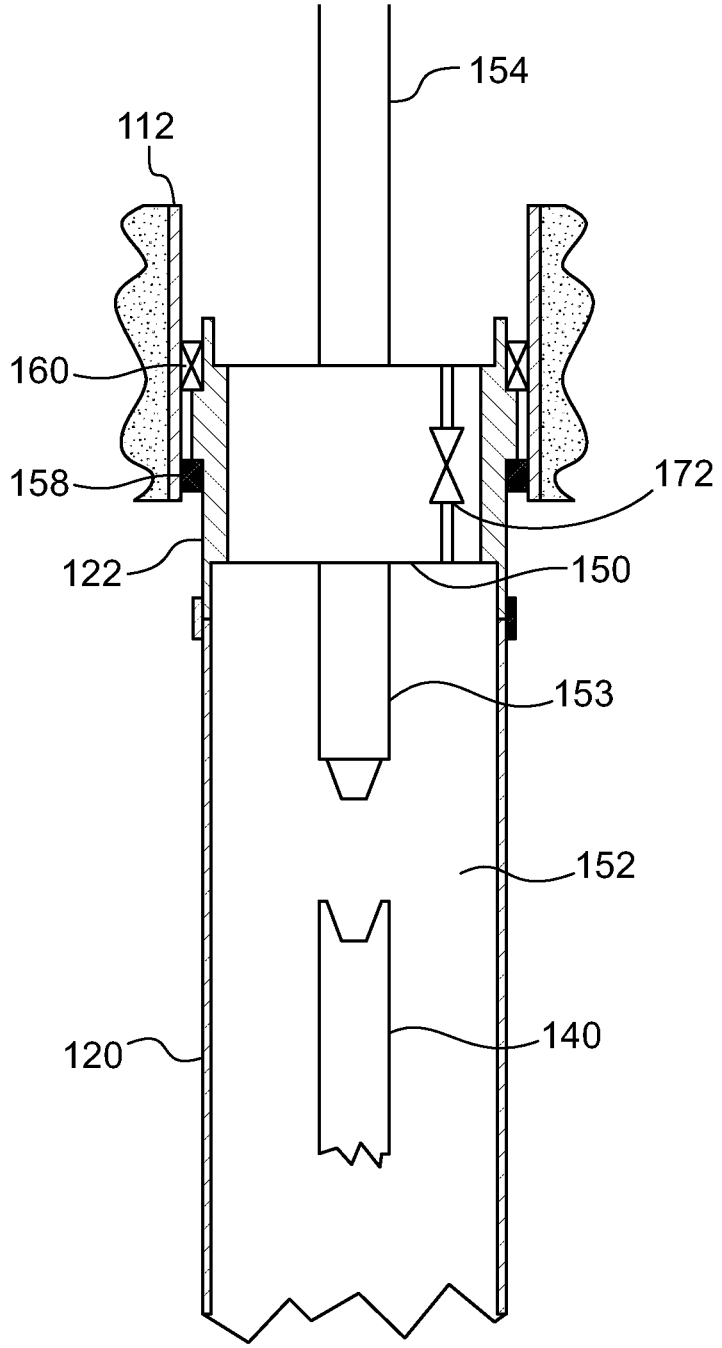

The upper or proximal end of the inner string 140 is then coupled to the tailpipe 153 of a liner running tool 150, illustrated in greater detail in FIG. 8, which tool 150 includes external left-handed threads configured to cooperate with matching internal threads on the upper or proximal end of the liner 120 or liner hanger 122. Alternatively, a J-slot arrangement may be provided to couple the tool 150 and the liner assembly. In other examples the liner hanger and running tool are provided as a pre-assembled unit. Other alternative arrangements include supplementary coupling arrangement between the running tool 150 and the liner 120, including collets and fingers, and shear out assemblies.

The inner string 140 is then lowered to compress the telescopic section 148 such that the splined portions disengage. The upper portion 140*a* may now be rotated to engage the running tool 150 with the liner hanger 122 at the upper end of the liner 120, without transfer of the rotation to the liner lower portion 140*b*.

Engaging the threads also ensures that a fluid-tight seal is created between the running tool 150, the inner string 140 and the liner 120 such that the drilling fluid 137 and air 138 are trapped and isolated within an inner annulus 152 created between the liner 120 and the inner string 140. This annulus 152 is filled the flowable material 137 and air 138.

A running string 154 is then connected to the liner assembly 168 comprising the liner 120, the inner string 140 and the running tool 150. Once the running tool 154 has been coupled and sealed to the upper end of the liner 120, the liner 120 may be hydraulically pressure tested, for example by pumping nitrogen into the inner annulus via a port 172 in the running tool 150.

The liner assembly 168 is suspended from a derrick 170 on the drilling unit 102 and is then lowered into the well 100, supported by the liner running string 154, until the liner 120 reaches target depth (FIG. 3). The assembly 168 is lowered through the seawater 180 between the drilling unit 102 and the seabed 113 and into the bore 106, which is itself filled with fluid 182. Although the Figures illustrate a vertical well, the method may also be usefully employed in an inclined well, or a well including a horizontal section. The presence of the air 138 in the inner annulus 152 provides the liner assembly 168 with a degree of buoyancy. This reduces the effective total weight, or hook load, experienced by the supporting apparatus on the drilling unit 102 when compared to a liner assembly that had been run in a conventional manner, that is filled with drilling fluid and containing no buoyant material. The capacity of the drilling unit 102 is thus effectively extended. In an inclined or horizontal well section the reduced effective weight of the assembly 168 will also reduce the friction between the assembly 168 and the low side of the well 100, facilitating translation of the assembly 168 and facilitating rotation of the assembly 168.

The provision of the inner string 140 permits the operator to circulate fluid through the liner running string 154 and the inner string 140, out of the shoe port 144 and then up through the outer annulus 124 between the liner 120 and the bore wall. This further facilitates translation of the liner assembly 168. For example, the liner shoe 134 may include jetting ports which clear or dislodge cuttings or other debris lying on the low side of the bore 106, or the fluid may be used to drive a rotating reamer shoe or the like.

Pumping fluid through the inner string 140 results in a higher pressure within the string 140 and this tends to axially extend the telescopic section 148, ensuring that the end connector 142 is urged into the shoe 134 and maintaining a sealed connection.

On reaching target depth, with the float shoe 134 slightly off the bottom of the well 100, the liner hanger 122 provided at the upper end of the liner 120 may be activated and slips 158 in the hanger 122 engage the surrounding casing 112, as illustrated in greater detail in FIG. 8. The slips 158 may be activated by landing a setting ball into a ball seat in the hanger 122 and then pressuring up to activate the slips 158. An overpressure may then be applied to shear out the ball and seat reinstate fluid circulation. The hanger 122 also includes seals 160 which are initially inactive and are activated after the liner 120 has been cemented.

The sequence of operations to circulate cement into the annulus 124 may vary depending on the well conditions but will typically involve circulating different fluids in a "fluid-train", one example of which will be described below. While the different fluids are being circulated, the operator may rotate the liner 120 in the bore 106, this facilitating removal of drill-cutting material from the annulus 124 and improving the distribution of cement in the annulus 124.

The operator will typically first circulate drilling mud/fluids, the fluids passing down the running string 154 and the inner string 140 and then passing out of the liner float shoe 134, before passing up through the annulus 124 between the liner 120 and the surrounding bore wall. The fluid then passes up through the running string annulus 174 to surface. The circulation of the drilling fluids establishes well circulation, ensures the well is completely filled with fluid, cleans the well and circulates out any drilling residue, and establishes a constant circulating temperature prior to cementing. The operator then circulates a chemical wash to circulate out the drilling fluid. The chemical may be surfactant-based, to thin, disperse and aid in drilling fluid removal, particularly within the outer annulus 124. A cement spacer fluid may then be circulated to ensure a physical separation between the previously circulated drilling fluids and the cement, which may be incompatible. For example, drilling fluids are often oil-based whereas cements typically water-based. The separation of the cement and drilling fluids is particularly important in the outer annulus 124 and is necessary to ensure the desired set cement properties and quality.

Cement slurry 126*a* is then prepared on the mobile offshore drilling unit 102 and pumped down through the liner running string 154, the liner running tool 150, the inner string 140, and through the flow port 144 in the shoe 134 (FIG. 4). The cementing operation may be commenced without the requirement to retrieve any of the apparatus used to locate the liner 120 in the bore 106.

The operator will have estimated the volume of cement slurry 126*a* required to fill the annulus 124 surrounding the liner 120 to provide a hydraulic seal around the liner 120 when the cement has set. The operator will typically prepare an excess of cement, for example 115% of this theoretical annular volume, that is a 15% excess, to accommodate, for example, washed-out or collapsed (and therefore larger volume) portions of annulus 124, or losses of cement slurry 126*a* into porous formations. The cement 126*a* will typically fill the annulus to at least the level of the liner hanger 122 and will flow over and past the liner hanger seals 160, although in other situations only a part of the annulus 124 may be filled, for example only a short section of cement may be provided in the annulus above the shoe 134.

During the cementing operation, the drilling rig personnel will monitor the volume of cement 126*a* being pumped into the well 100 and the volume of drilling fluid being returned or displaced from the well 100. As noted above, the liner 120 may be rotated as the cement 126*a* is being circulated, to facilitate mud removal and to evenly distribute of the cement around the annulus 124.

Figure 6:
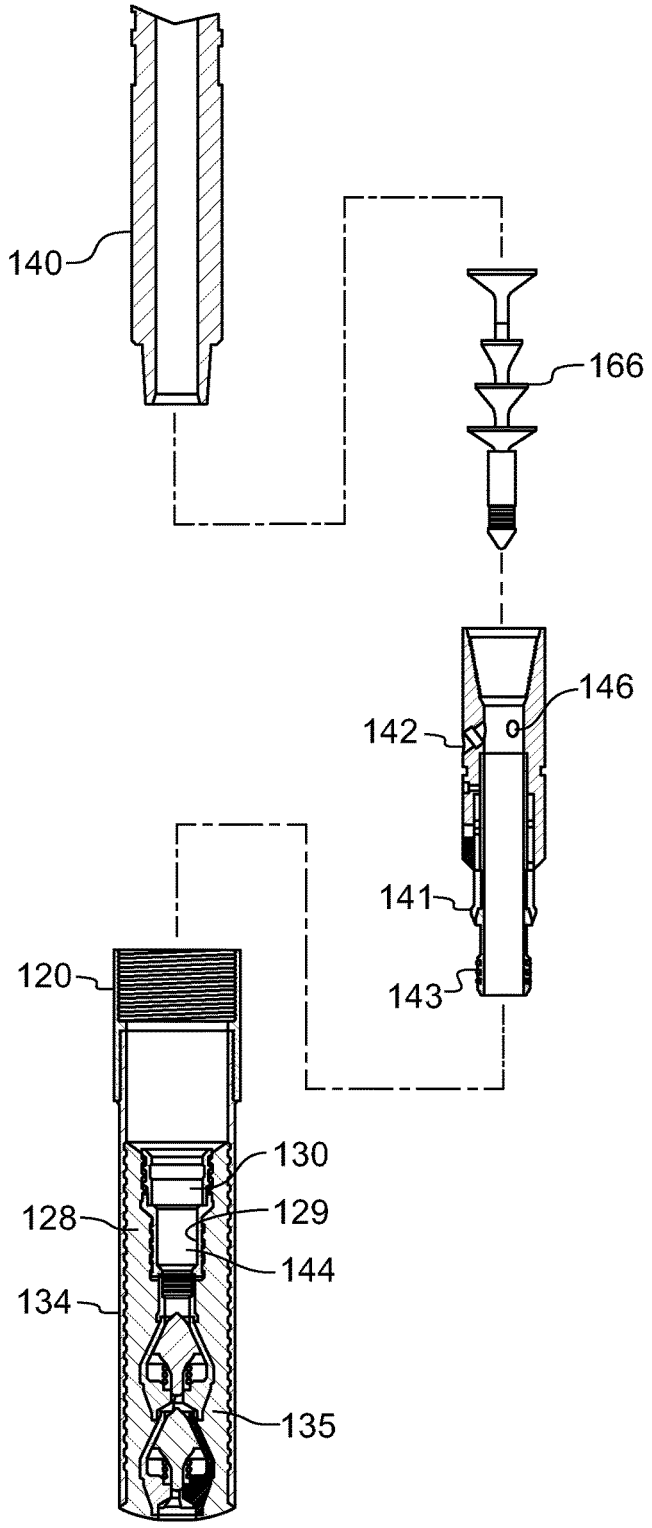
FIGS. 6 to 9 illustrate details of the apparatus of FIGS. 1 to 5.
Figure 7:
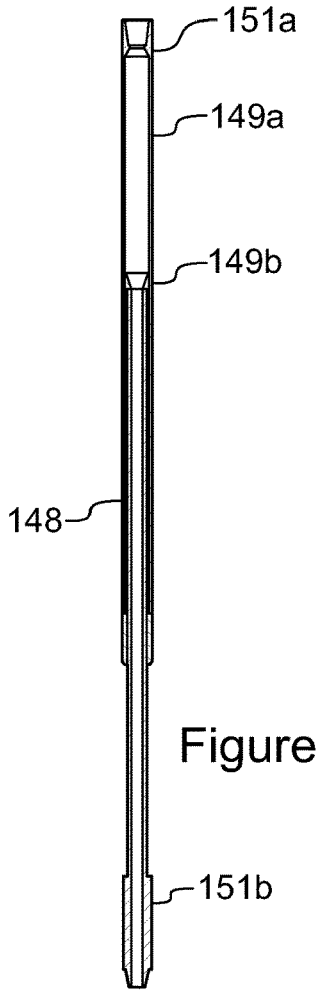

The volume of cement 126*a* may be separated from the following displacement fluid 164, which may be a drilling fluid, by a top plug 166 as illustrated in FIG. 6, though in other examples a ball may be used. The cement 126*a* is thus pumped through the liner running string 154, the liner running tool 150, the inner string 140, and the flow port 144 in the shoe 134, until the plug 166 lands in the shoe coupling 128 and blocks the flow port 144. The plug 166 includes a seal and a latch arrangement and is locked and sealed in the coupling 128, sealing the port 144 and thus preventing any possibility of U-tubing, that is the dense cement slurry 126*a* flowing down and out of the annulus 124 and back through the port 144.

During the cement circulating operation the air 138 in the inner annulus 152 remains at atmospheric pressure, isolated from the fluid in the well and isolated from the cement slurry 126*a* being pumped through the inner string 140. Accordingly, there is no tendency for the liner 120 to balloon outwards, as may occur in a conventional operation where cement is pumped and displaced down through the liner at high pressure, and such that the liner 120 may then contract when the cement pumping operation is completed, and the cement slurry replaced with drilling fluid or brine at hydrostatic pressure. This contraction may lead to the creation of a small annular gap between the cement 126 in the outer annulus 124 and the outer surface of the liner 120 and thus have an adverse effect on the integrity of the cement seal. In the present disclosure the liner 120 will experience a substantially lower internal pressure while cement 126*a* is being pumped into the outer annulus 124 and will thus be more likely to radially contract under the influence of the hydrostatic pressure of the cement slurry 126*a* in the outer annulus 124. When the cementing operation has been completed the pressure in the outer annulus 124 will likely decrease as the cement slurry 126*a* hardens and sets, while the pressure inside the liner 120 will increase as the inner annulus 152 is brought up to hydrostatic pressure, such that the wall of the liner 120 will tend to move radially outwards into closer contact with the surrounding sheath of set cement 126.

Once pumping of the cement 126*a* into the annulus 124 has been completed the operator continues to apply pressure within the inner string 140 to open the ports 146, thus providing access to the inner annulus 152. The pressure in the inner annulus 152 and the pressure in the inner string 140 will then equalise. This will result in the air 138 in the annulus 152 being compressed and reducing markedly in volume, and potentially being substantially dissolved into the drilling fluid that fills the annulus 152.

The liner hanger running tool 150 is then mechanically disengaged from the liner hanger 122, for example by rotation of the running tool 150 relative to the liner assembly; the fluid seal between the running tool 150 and the liner hanger/liner assembly is maintained. The liner hanger seals 160 for sealing the upper end of the outer annulus 124 may then be activated. In one example a push-pull test is carried out, with weight being applied to the liner hanger 122 via the running tool 150 to activate the seals 160 and bed-in the liner hanger slips 158. Tension is then applied to the liner hanger 122, and further secures the seals 160 and the slips 158.

Figure 9:
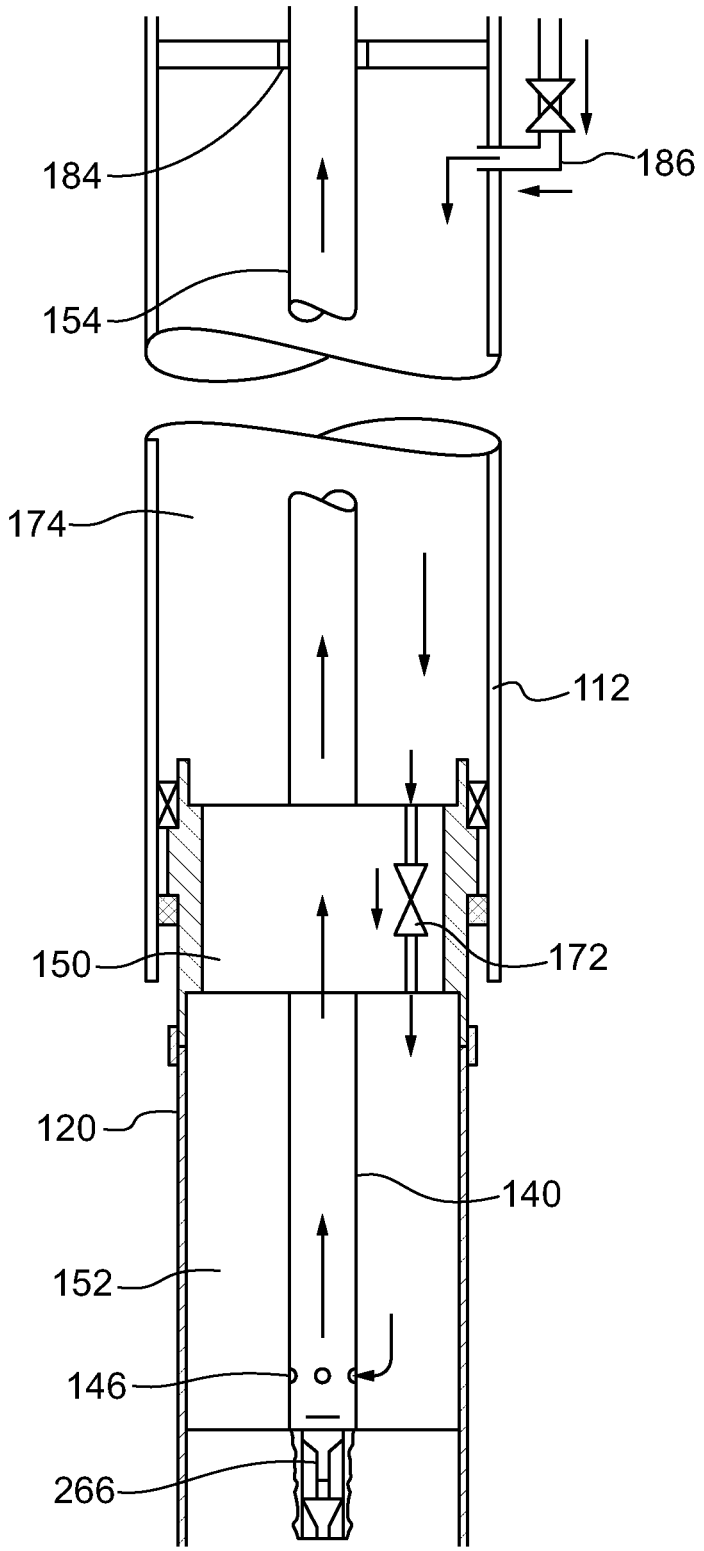

The liner running tool 150 includes a port provided with a valve 172 which permit control of flow between the inner annulus 152 and the running string annulus 174. If the valve 172 is closed, fluid may be pumped into the inner annulus 152 through the lower port 146 to conduct a pressure test of the liner 120. This will result in the further pressurisation of the air 138 and the volume of the air 138 will further decrease. With the valve 172 open, fluid may be circulated from surface down through the running string 154 and the inner string 140 and out of the port 146 to circulate the air 138 out of the inner annulus 152 (FIG. 5). Alternatively, and as illustrated in FIG. 9, with the BOP seal rams 184 engaging the running string 154 and sealing the upper end of the annulus 174, fluid may be reverse circulated from surface through the BOP kill line 186 and into the annulus 174 between the running string 154 and the casing 112, and through the running tool valve 172, to displace the air 138 through the ports 146 and up through the inner string 140 and the running string 154. Further, any excess cement 126*a* which had spilled over the upper end of the liner 120 and into the annulus 174, and may be sitting above the running tool 150, is flushed through the valve 172 into the inner annulus 152 and ultimately carried to surface through the inner string 140 and the running string 154. The entrained cement may be separated from the circulating fluid at surface. Further reverse circulation of fluid through the inner annulus 152 will also flush any residual cement 126*a* in the string 140 out of the well 100.

Air 138 which is displaced out of the inner annulus 152 will pass up through the fluid in the running string annulus 174, or alternatively up through the inner string 140 and the running string 154. While the elevated pressure experience in the bore 106 may result in the air 138 initially being subject to substantial compression and dissolving in the other fluid present in the bore 106, the air 138 will expand as it moves upwards towards the surface and hydrostatic pressure decreases. The operator will take appropriate steps to control and contain the air 138 using the well control systems of the mobile offshore drilling unit 102, for example a sub-sea blow-out preventer (BOP) provided on the seabed 113 will seal in the well 100 and choke and kill lines may be used to direct flow into and out of the well, and a surface manifold and choke on the unit 102 will be used to control, separate, and divert flow at surface.

The operator will then continue to circulate drilling fluid, for example circulating two or three times the well volume, to ensure that all the air has been dispersed and removed from the well 100, before releasing the BOP seal rams 184.

In alternative examples the port 146 may feature a different valve arrangement. For example, the port 146 may include a valve which opens in response to a predetermined sequence of pressure pulses or a predetermined flow sequence, such as on/off/on/off. In another example the port 146 may include a valve which operates in response to surface deployed communication, such as RFID tags which may be pumped into the inner string 140 when it is desired to change the configuration of the valve to open or close the port 146.

When the operator is ready to retrieve the liner running assembly, the liner running string 154 is manipulated to disengage the liner running tool 150 from the liner hanger 122 and the upper end of the liner 120. The liner running string 154 is then raised to extend the telescopic section 148 in the inner string 140, allowing torque to be transferred between the inner string portions 140*a*, 140*b*, to disengage the couplings 128, 142 between the inner string 140 and the liner shoe 134. Alternatively, the couplings 128, 142 may be separated by application of a predetermined tension or pull.

Once the cement 126 has set, any further operations, for example perforating the liner 120, may be carried out immediately. There is no requirement to drill out a plug of cement, or the associated plugs and float collar, from the distal end of the liner 120, as would be the case with a conventional liner cementing operation. This provides for a considerable saving in time, reduces the equipment required to be provided on the drilling unit 102, and avoids the potential for damage to the liner 120 and the cement 126 from the drilling operation.

Reference is now made to FIGS. 10 to 14 of the drawings, which illustrates a deep-water oil and gas exploration well 200. The well 200 shares many features with the well 100 described above and, in the interest of brevity, some of the common features will not be described again in any detail. Common features may be labelled with the same reference numerals, incremented by 100.

As with the first example, the illustrated well construction operations are being conducted primarily from a mobile offshore drilling unit 202 on the sea surface 204. The well 200 includes a bore 206 which has been drilled from the seabed/mud line 213 in sections and lined with successively smaller bore-lining tubing sections 208, 210, 212, 220.

The illustrated well 200 includes three casing sections 208, 210 and 212 which extend back to the seabed 213. An annulus 214 surrounds each casing 208, 210, 212 and is at least partially filled with cement 216. The Figures illustrate the installation of a liner 220 which extends to the end of the bore 206. The liner 220 is sealed and secured to a distal portion of the innermost casing 212 with a liner hanger 222. An outer annulus 224 between the liner 220 and the surrounding bore wall will be sealed with cement 226.

Figure 10:
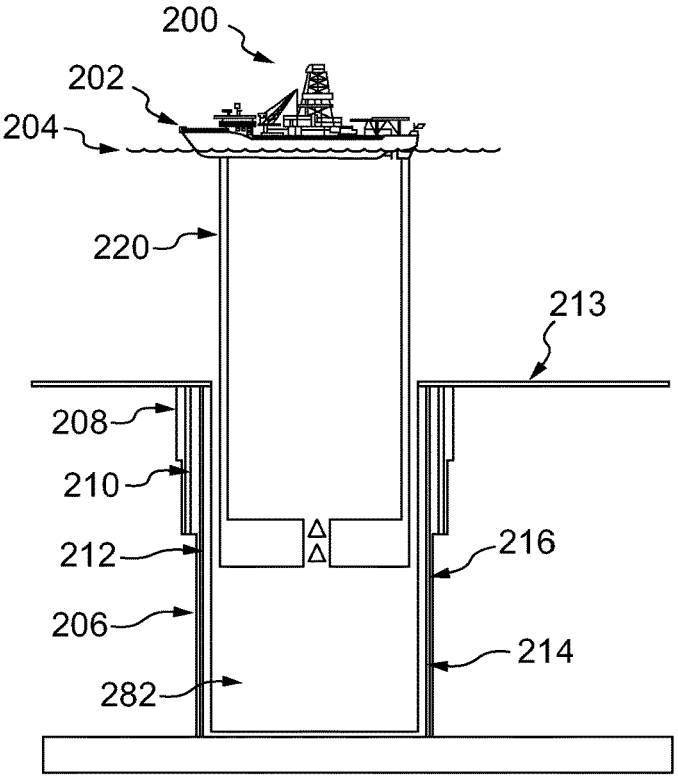
FIGS. 10 to 14 are schematics of a deep-water oil and gas well illustrating a well construction method in accordance with a second aspect of the present disclosure.

The liner 220 is made up from liner sections on the deck of the drilling unit 202 (FIG. 10). The leading or distal end of the liner 220 is provided with a liner shoe 234. The shoe 234 is a float shoe including a double check-valve 235 and has a coupling including a sealing face to allow an end adaptor or latch-in coupling tool 242 on the end of an inner string 240 to form a sealing engagement with the shoe 234, as will be described.

Once the liner 220 has been made up and is suspended from the slips on the deck of the drilling unit 202, the inner string 240 is made up and run into the liner 220, the string 240 being provided with a packer 276. The inner string 240 includes a latch-in coupling or connector 242 which is latched into a coupling provided in a flow passage 244 in the liner shoe 234.

The lower or distal end of the inner string 240 includes a port 246 including a burst disc, or other form of selectable valve. The inner string 240 also includes a telescopic section 248. When the telescopic section 248 is extended, as may occur due to gravity pulling on the lower end of the string 240 and as occurs when the interior of the string experiences elevated fluid pressure, complementary splined portions engage and permit the transfer of torque through the section 248. However, when the section 248 is retracted or compressed an upper portion of the string 240*a* is rotatable relative to a lower portion 240*b*. The telescopic section 248 may include features such as described in GB2525148A, GB2545495A and GB1911653.2 the disclosures of which are incorporated herein in their entirety.

The upper or proximal end of the inner string 240 is then coupled to a liner running tool 250 which includes external left-handed threads configured to cooperate with matching internal threads on the upper or proximal end of the liner 220.

Figure 11:
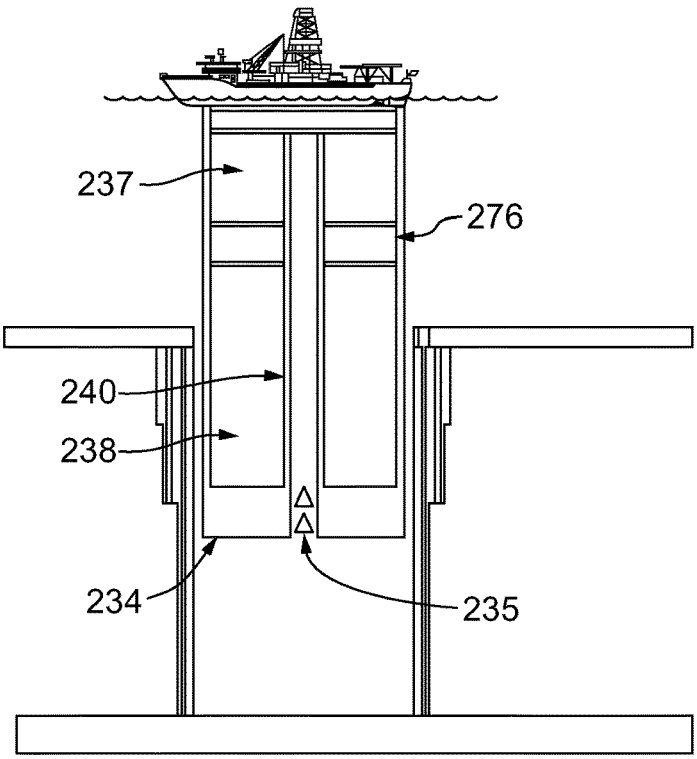

The inner string 240 is then lowered to compress the telescopic section 248 such that the splined portions disengage. The upper portion 240*a* may now be rotated to set the packer 276 to form a sealing barrier within the inner annulus 252 between the inner string 240 and the liner 220 and thus divide this inner annulus 252 into an upper portion 252*a* and a lower portion 252*b*. The lower portion 252*b* is filled with air 238. After setting the packer 276 the upper portion 252*a* is filled with fluid 237 (FIG. 11). In other examples the packer could be set by reciprocation, rotation, or pressure.

The inner string 240 is lowered to engage the running tool 250 with the upper end of the liner 220, without transfer of the rotation to the liner lower portion 240*b*. A fluid-tight seal is created between the running tool 250, the inner string 240 and the liner 220 such that the drilling fluid 237 and air 238 are trapped and isolated within the inner annulus 252.

Figure 12:
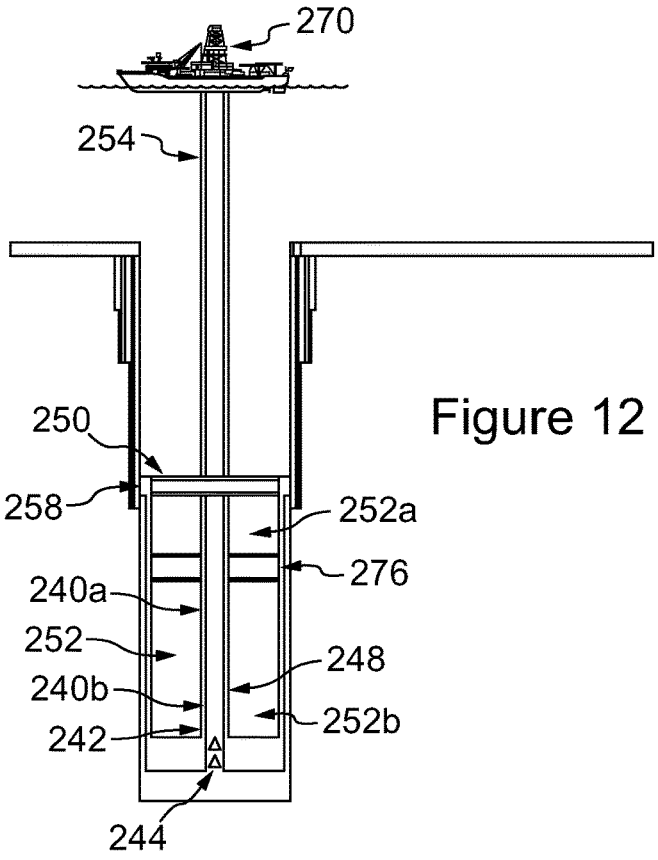
Figure 13:
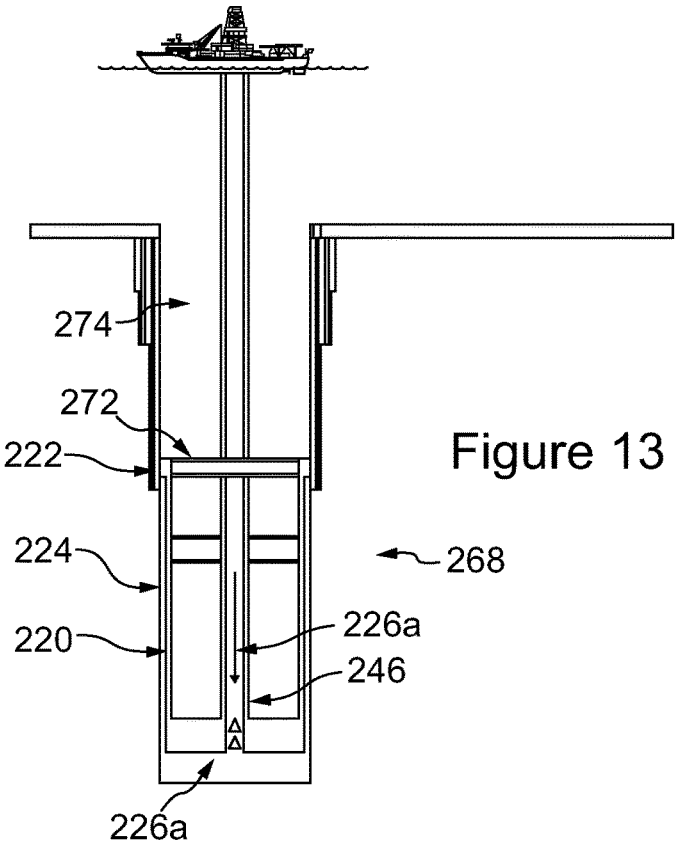
Figure 14:
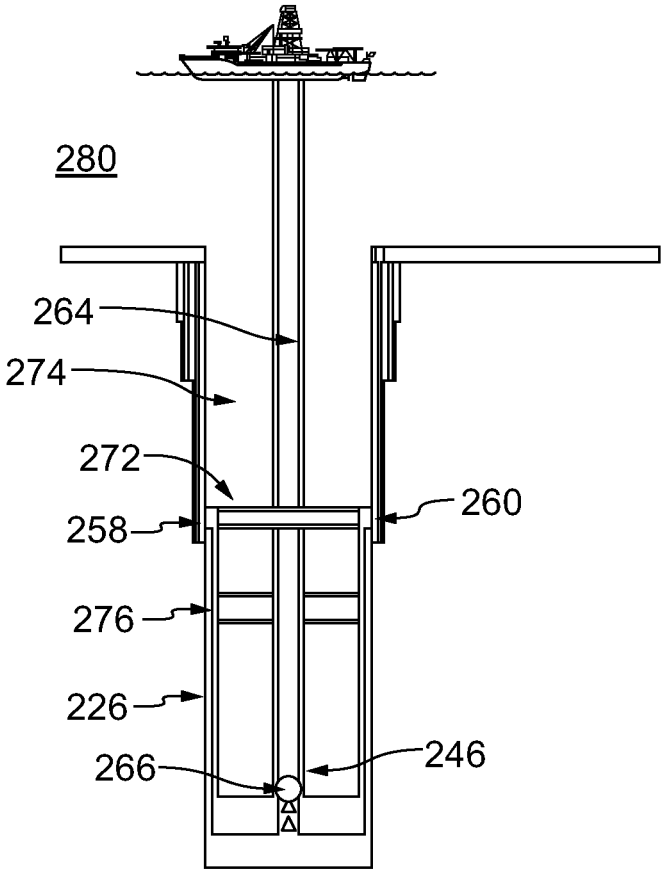

A running string 254 is then connected to the liner assembly 268 and the liner assembly 268 is lowered into the well 200, suspended from a derrick 270 on the drilling unit 202 and supported by the liner running string 254, until the liner 220 reaches target depth (FIG. 12). The assembly 268 is lowered through the seawater 280 between the drilling unit 202 and the seabed 213 and into the bore 206, which is itself filled with fluid 282. The presence of the air 238 in the inner annulus lower portion 252*b* provides the liner assembly 268 with a degree of buoyancy. As with the first example, this reduces the effective total weight, or hook load, experienced by the supporting apparatus on the drilling unit 202 when compared to a liner assembly that had been filled with drilling fluid and contains no buoyant material. Further, in an inclined or horizontal well section the buoyancy introduced by the air 238 in the lower inner annulus 252*b* reduces the effective weight of the assembly 268 and reduces the friction between the assembly 268 and the low side of the well 200, facilitating axial translation and rotation of the assembly 268.

The provision of the inner string 240 permits the operator to circulate fluid through the liner running string 254, the inner string 240, and the outer annulus 224.

On reaching target depth the liner hanger 222 provided at the upper end of the liner 220 is activated and slips 258 in the hanger 222 engage the surrounding casing 212.

The liner 220 is then cemented in a similar manner to the liner 120 described above. Given the reduced effective weight of the assembly 268, and the reduced friction between the assembly 268 and the surrounding bore wall, it is possible to rotate the liner 220 as cement slurry 226*a* is circulated up the outer annulus 224, which improves the quality of the bond formed between the liner 220 and the surrounding cement 226.

Once the desired volume of cement 226*a* has been pumped into the well 200 a displacement fluid 264 separated from the cement 226*a* by a top plug and/or ball 266. The cement 226*a* is thus pumped through the liner running string 254, the liner running tool 250, the inner string 240, and the flow port 244 in the shoe 234, until the ball 266 lands in and blocks the flow port 244. The ball 266 is locked in the port 244 thus preventing any possibility of U-tubing, that is the dense cement slurry 226*a* flowing down and out of the annulus 224 and back through the port 244.

Once the desired amount of cement 226*a* has been pumped into the bore 206 the liner hanger seals 260 may be set to provide a fluid-tight seal between the upper end of the liner 220 and the surrounding casing 212.

A further increase in pressure in the inner string 240 opens the port 246. Fluid may then be pumped into the distal volume 252*b* and the air 238 compressed. The liner running tool 250 also includes a port provided with a valve 272 which controls flow into and from the proximal portion 252*a* of the inner annulus 252.

When the operator is ready to retrieve the liner running assembly, the liner running string 254 is rotated to disengage the liner running tool 250 from the upper end of the liner 220. The liner running string 254 is then raised further to unset the packer 276 within the inner annulus 252, allowing the compressed air 238 in the distal volume 252*b* to mix with the fluid 237 in the proximal volume 252*a*.

Fluid from the volume 274 above the assembly 268 may be reverse circulated through the inner annulus 252, through the flow-passage 246 and back up the inner-string 240 to surface. This reverse circulation removes any entrapped air and circulates the well 200 back to a single fluid.

To facilitate safe displacement of the air 238 out of the well 200, and prior to retrieving the liner running assembly, the well control system of the mobile offshore drilling unit 202 is utilised to control the flow of fluid from the well 200. This could involve use of the sub-sea blow-out preventer to seal in the well 200, including the running string annulus 274, choke and kill lines to direct and control flow into and out of the well 200, and the surface manifold and choke to control, separate and divert well fluid flow at surface.

The liner running string 254 is then raised further to extend the telescopic section 248 in the inner string 240, allowing torque to be transferred between the inner string portions 240*a*, 240*b*, to disengage the bottom end of the inner string 240 from the liner shoe 234. The running string 254, running tool 250 and inner string 240 may then be retrieved to surface.

In the example described above the liner assembly 268 is run into the bore 206 with a portion of the inner annulus 252*b* filled with air 238 at atmospheric pressure. The skilled person will appreciate that this will result in an imbalance of pressure acting on the liner 220 as the assembly is run deeper into the bore 206 and the surrounding hydrostatic pressure increases. The upper or proximal portion of the inner annulus 252*a* is filled with substantially incompressible drilling fluid 237 which will support the corresponding portion of the liner 220. Clearly, the skilled person will ensure that the liner 220 surrounding the air-filled portion of the inner annulus 252*b* is selected to withstand the expected hydrostatic pressure forces and temperature-related expansion forces that will result in pressure changes.

In other examples the operator may pressurise the inner annulus 152, 252, for example by pumping material into the annulus after the annulus volume has been sealed by the running tool 150, 250. For example, the operator may pump air or an inert gas, such as nitrogen, into the volume.

It will be apparent to the skilled person that many of the elements of the various well constructions described above may be modified or omitted. For example, a packer, swab cup or the like may be provided in the inner annulus of the first example to separate the drilling fluid from the air. In a variation of the second example multiple packers may be provided, allowing three or more separate volumes to be provided within the annulus 252. The location of the buoyant material within the inner annulus may also be varied as desired.

The skilled person will appreciate that there are a variety of liner hangers available from a variety of different suppliers, and that the liner hanger setting steps and procedures described above are only provided by way of example.

In the above examples the buoyant material comprises air. In other examples the buoyant material may comprise another gas, such as nitrogen, a liquid such as a low specific gravity/density oil, or a solid material such as rigid foam or gas-filled spheres. The buoyancy provided by the buoyant material may be enhanced by maintaining the buoyant material at a relatively low pressure, such as the examples described above where air is retained within an inner annulus and maintained at or close to atmospheric pressure. In other examples the buoyant material may be pressurised or may be at the same pressure as the surrounding ambient fluid but be selected to have a lower specific gravity/relative density than the ambient fluid.

The examples described above feature a telescopic section 148, 248, serving as a slip joint, which may be extended by internal pressure. As noted above, this may be useful in ensuring that the latch-in end connector 142, 242 remains in sealing contact with the shoe 134, 234, however in other examples a pressure neutral telescopic section may be provided, that is the section does not tend to extend in response to pressure differentials.

The examples described above reduce the effective weight of the liner assembly supported by the derrick on the drilling unit. This may permit a drilling unit to be used to install bore-lining tubing that would otherwise exceed the safe working capabilities of the unit or derrick. Thus, rather than being forced to source a more expensive mobile drilling unit with a higher weight-handling capacity, or having to separately run and install two liners, an operator may install a relatively long liner in a single run. Further, operators will sometimes run casing or liner into a well with the assistance of gravity, but if a problem arises the operator may be unable to pull the casing or liner back out of the well. The operator may thus be forced to install the casing or liner short of target depth. By using the present disclosure to reduce the effective weight of the casing or liner assembly, it is more likely that the operator will retain the capability to retrieve the casing or liner and resolve the problem that is preventing the tubing being run to target depth.

Figure 15:
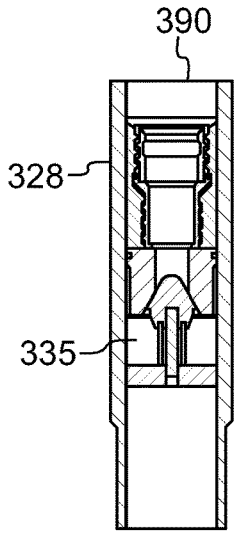
FIG. 15 is a sectional view of a float collar in accordance with an aspect of the disclosure (on same sheet as FIGS. 6 and 7)

The examples described above feature double check-valves in the liner shoes. In other examples single valves may be provided, or the shoes may be configured to auto-fill. In other examples the inner string may engage with a coupling provided in a float collar, rather than in a float shoe, to allow provision of a short shoe track. Such a float shoe 390 is illustrated in FIG. 15 and includes a coupling 328 to engage with a coupling (such as the coupling 142 described above) provided on an inner string, and a single check valve 335.

The examples include latch-in connectors at the distal ends of inner string. In other examples the connectors may simply be sealing connectors.

In the above examples the liner internal volumes are part-filled with air and part-filled with liquid. In other examples the liner internal volume may remain entirely filled with ambient air, that is no liquid is placed in the volume.

The running tools 150, 250 described above are provided with valves 172, 272, and these valves may be accessible via ROV. In other examples the liners will be installed through a riser connecting the drilling unit to the wellhead, and the running tools will not be ROV accessible, and thus will not be provided with such valves. In such a situation circulation, whether conventional or reverse, may be established once the running tool has been picked up above the hanger element and a flow path is opened between the running tool annulus and the inner annulus.

Figure 16:
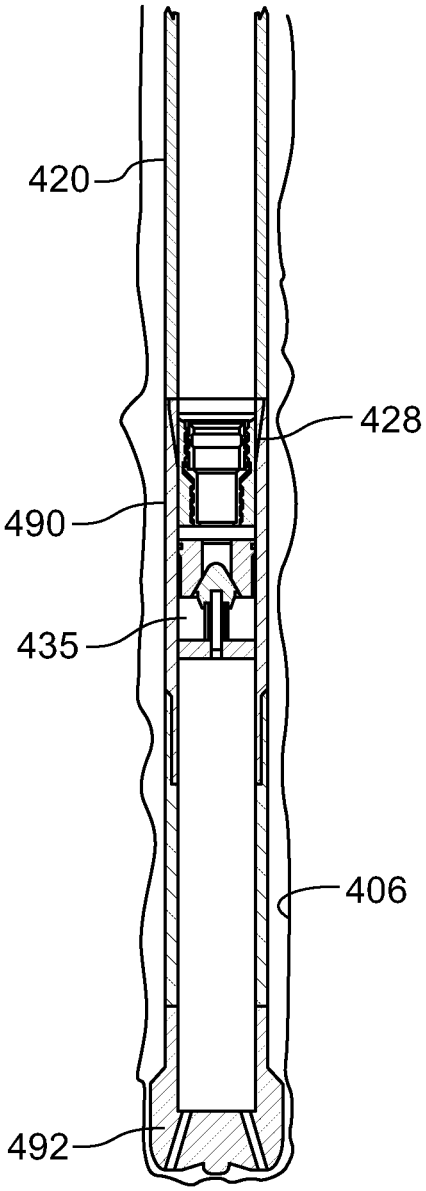
FIG. 16 is a sectional view of the distal end of a casing in accordance with apparatus in accordance with a further aspect of the disclosure.

The examples described above relate to the placing of a liner in a pre-drilled hole. Aspects of the disclosure may also be useful in drilling—with buoyant casing operations, where a cutting structure, such as a drill bit, is provided on the distal end of a casing or liner string and the cutting structure is used to form the bore that the casing or liner will line; there is no requirement to retrieve a drill string to surface and then separately make up and run in the bore-lining tubing. FIG. 16 is a sectional view of the distal end of a casing for such an application. The casing 420 includes a float collar 490 including a single check valve 435 and a drill bit 492 is provided on the end of the casing 420, rather than a non-cutting shoe. The collar 490 includes a coupling arrangement 428 for cooperating with a corresponding coupling provided on the distal end of the inner string.

The presence of the buoyant material in the casing 420 greatly reduces its overall weight and facilitates rotation of the casing 420 to rotate the bit 492, and reduces the friction experienced as the casing 420 is advanced through the drilled bore 406. Further, the direct coupling of the distal end of the inner string to the distal end of the casing 420 facilitates circulation of drilling fluid during well cleaning and the drilling operation.

Further, the drawings illustrate methods being utilised in deep-water applications, with operations being conducted from a mobile offshore drilling unit. The skilled person will recognise that the methods and apparatus described may also be utilised in shallower water, and indeed in land wells, and may be conducted from platforms, drill ships, or land rigs.

REFERENCE NUMERALS deep water well 100
mobile offshore drilling unit 102
sea surface 104
bore 106
casing sections 108, 110 and 112
seabed 113
casing section annuli 114
cement 116
liner 120
liner hanger 122
outer annulus 124
outer annulus cement 126
outer annulus cement slurry 126*a*
float shoe coupling 128
shoe seal bore 129
latch profile 130
liner shoe 134
double check-valve 135
liner internal volume 136
flowable material 137
air 138
inner string 140
upper string portion 140*a*
lower string portion 140*b*
latch 141
latch-in end connector 142
seals 143
shoe flow passage/port 144
valved port 146
telescopic section 148
outer member 149*a*
inner member 149*b*
liner running tool 150
box connection 151*a*
pin connection 151*b*
inner annulus 152
tail pipe 153
liner running string 154
liner hanger slips 158
liner hanger seals 160
displacement fluid 164
plug 166
liner assembly 168
derrick 170
liner running tool valve/port 172
running string annulus 174
seawater 180
well fluid 182
BOP seal rams 184
BOP kill line 186
deep water exploration well 200
mobile offshore drilling unit 202
sea surface 204
bore 206
casing 208, 210, 212
seabed/mudline 213
casing annulus 214
cement 216
liner 220
liner hanger 222
outer annulus 224
cement 226
cement slurry 226*a*
liner shoe 234
double check-valve 235
drilling fluid 237
air 238
inner string 240
string portions 240*a*,240*b*
latch-in tool 242
flow passage 244
flow port 246
telescopic section 248
liner running tool 250
inner annulus 252
annulus portions 252*a*, 252*b*
running string 254
hanger slips 258
hanger seals 260
displacement fluid 264
plug/ball 266
liner assembly 268
derrick 270
liner running tool valve/port 272
running string annulus 274
packer 276
seawater 280
well fluid 282
coupling 328
check valve 335
float shoe 390
casing 420
coupling 428
check valve 435
float collar 490
drill bit 492

The invention claimed is:

1. A method of locating bore-lining tubing in a drilled bore, the method comprising:

selecting a buoyant material having a density lower than the density of an ambient fluid filling a drilled bore;

locating the buoyant material in a bore-lining tubing;

locating an inner tubing within the bore-lining tubing, with the inner tubing extending from a distal end of the bore-lining tubing to a proximal end of the bore-lining tubing and defining an inner annulus between the inner tubing and the bore-lining tubing;

coupling and sealing a distal end of the inner tubing to the distal end of the bore-lining tubing by engaging a coupling on the inner tubing with a coupling on the bore-lining tubing;

sealing the inner tubing to a portion of the bore-lining tubing at a location spaced from the distal end thereof to isolate a portion of the inner annulus between the distal end and the sealing location;

retaining a volume of the buoyant material within the isolated portion of the inner annulus and running an assembly comprising the inner tubing and the bore-lining tubing and containing the volume of buoyant material retained within the isolated portion of the inner annulus into the ambient fluid-filled drilled bore;

flowing fluid through the inner tubing and into an outer annulus surrounding the bore-lining tubing while containing and retaining the volume of buoyant material within the isolated portion of the inner annulus; and opening a port in the distal end of the inner tubing and flowing fluid between the inner tubing and the inner annulus via the port.

2. The method of claim 1, comprising flowing a settable material through the inner tubing and into the outer annulus to at least partially fill the outer annulus, and subsequently separating the coupling on the distal end of the inner tubing from the coupling in the distal end of the bore-lining tubing and retrieving the inner tubing from the bore-lining tubing.

3. The method of claim 1, comprising at least one of: at least partially filling the isolated portion of the inner annulus with buoyant material, and completely filling the isolated portion of the inner annulus with buoyant material.

4. The method of claim 1, wherein the buoyant material comprises a gas.

5. The method of claim 4, comprising circulating the buoyant material out of the inner annulus and controlling the release of the buoyant material from the bore.

6. The method of claim 1, comprising at least one of: part-filling the isolated portion of the inner annulus with a second material having a density higher than the density of the buoyant material; part-filling the isolated portion of the inner annulus with a second material having a density higher than the density of the buoyant material and locating the buoyant material in the isolated portion of the inner annulus after the locating the second material in the inner annulus, and locating the buoyant material in the isolated portion of the inner annulus and then locating a second material having a density higher than the buoyant material in the inner annulus.

7. The method of claim 1, comprising forming at least two isolated portions in the inner annulus.

8. The method of claim 1, comprising injecting fluid into the isolated portion of the inner annulus to increase the pressure within the isolated portion.

9. The method of claim 1, comprising latching the coupling at the distal end of the inner tubing into the coupling at the distal end of the bore-lining tubing.

10. The method of claim 1, comprising at least one of: coupling and sealing a proximal end of the inner tubing to the proximal end of the bore-lining tubing, and coupling and sealing a proximal end of the inner tubing to the proximal end of the bore-lining tubing and subsequently uncoupling the proximal end of the inner string from the proximal end of the bore-lining tubing before disengaging the coupling on the distal end of the inner tubing from the coupling on the distal end of the bore-lining tubing.

11. The method of claim 1, comprising at least one of: setting a hanger provided on the proximal end of the bore-lining tubing, and setting a hanger provided on the proximal end of the bore-lining tubing and setting hanger slips to engage a surrounding tubing and subsequently setting a hanger seal to provide sealing engagement between the bore-lining tubing and the surrounding tubing.

12. The method of claim 1, comprising at least one of: locating the proximal end of the bore-lining tubing beneath a body of water; locating the proximal end of the bore-lining tubing within the drilled bore, and providing the bore-lining tubing in the form of casing and locating the proximal end of the casing at the seabed.

13. The method of claim 1, wherein the step of flowing fluid through the inner tubing and into an outer annulus surrounding the bore-lining tubing while containing and retaining the volume of buoyant material within the isolated portion of the inner annulus comprises at least one of:

(a) circulating fluid whilst running the assembly into the drilled bore to dislodge material from the bore;

(b) circulating fluid whilst the assembly is at target depth in the drilled bore;

(c) circulating fluid whilst rotating the assembly;

(d) circulating drilling fluid to at least one of: establish circulation, ensure the bore is filled with fluid; clean the bore and circulate out any drilling residue, and establish a constant circulating temperature, and (e) circulating a cement fluid-train comprising at least one of: a chemical wash; a cement spacer fluid; a cement slurry; and a cement displacement fluid.

14. An assembly for location downhole, the assembly comprising: bore-lining tubing for location in a drilled bore; an inner tubing for extending from a distal end of the bore-lining tubing to a surface structure; a coupling at the distal end of the bore-lining tubing; a coupling at a distal end of the inner tubing for engaging and sealing with the coupling at the distal end of the bore-lining tubing; a proximal seal between the bore-lining tubing and the inner tubing; a sealed inner annulus between the distal ends of the bore-lining tubing and the inner tubing and the proximal seal; a selectively openable flow port in the distal end of the inner tubing for flowing fluid between the inner tubing and the inner annulus, and a volume of buoyant material retained within the inner annulus, the assembly having a first configuration and a second configuration, in the first configuration the flow port in the distal end of the inner tubing being closed and the volume of buoyant material being sealed within the inner annulus and the inner annulus being isolated from the inner tubing, and in the second configuration the flow port in the distal end of the inner tubing being open whereby fluid may flow between the inner tubing and the inner annulus.

15. The assembly of claim 14, comprising a selectively openable flow port at a proximal end of the bore-lining tubing for flowing fluid between the inner annulus and a volume of the bore above the bore-lining tubing.

16. The assembly of claim 14, wherein at least one of the coupling at the distal end of the inner tubing and the coupling at the distal end of the bore-lining tubing comprise a latch arrangement.

17. The assembly of claim 14, comprising at least one of: a coupling between the inner tubing and a proximal end of the bore-lining tubing, and a seal between the inner tubing and the proximal end of the bore-lining tubing.

18. The assembly of claim 14, comprising: a hanger for securing and sealing the bore-lining tubing in the drilled bore, and a hanger setting tool associated with the inner tubing.

19. The assembly of claim 14, comprising a cutting structure mounted on the distal end of the bore-lining tubing.

20. A method of cementing bore-lining tubing in a drilled bore, the method comprising:

isolating at least a portion of an inner annulus defined between a bore-lining tubing and an inner tubing extending through the bore-lining tubing, with the isolated portion of the inner annulus containing a compressible fluid;

flowing cement slurry through the inner tubing and into an outer annulus surrounding the bore-lining tubing, with the cement slurry in the inner tubing at a first pressure;

flowing a second fluid into the inner tubing whereby a column of the second fluid in the inner tubing generates a hydrostatic pressure while maintaining the compressible fluid contained within the isolated portion of the inner annulus at a second pressure lower than the first pressure and lower than the hydrostatic pressure generated by the column of the second fluid in the inner tubing;

maintaining the compressible fluid contained within the isolated portion of the inner annulus at the second pressure at least until the cement slurry in the outer annulus has at least partially set, and then exposing the compressible fluid contained within the isolated portion of the inner annulus to the hydrostatic pressure generated by the column of the second fluid in the inner tubing once the cement slurry in the outer annulus has at least partially set.

* * * * *